US005478138A

United States Patent [19]

Yu

[11] Patent Number: 5,478,138

[45] Date of Patent: Dec. 26, 1995

[54] SECURITY DEVICE FOR A FOLDABLE CHAIR

[76] Inventor: Ali Yu, No. 324, Alley 52, Lane 46, Sec. 2, Yuanta Rd., Yuanlin Chen, Changhua Hsien, Taiwan

[21] Appl. No.: 287,743

[22] Filed: Aug. 9, 1994

[51] Int. Cl.[6] ..... A47C 9/00

[52] U.S. Cl. ..... 297/461; 297/16.1; 108/120

[58] Field of Search ..... 297/56, 16.1, 334, 297/461; 108/118, 120, 131; 248/164, 432

[56] References Cited

U.S. PATENT DOCUMENTS

| | | | |
|---|---|---|---|
| 344,834 | 7/1886 | Hines | 108/118 |

FOREIGN PATENT DOCUMENTS

| | | | |
|---|---|---|---|
| 687207 | 5/1964 | Canada | 297/56 |
| 923267 | 2/1955 | Germany | 297/56 |
| 1941803 | 2/1971 | Germany | 297/56 |
| 2185182 | 7/1987 | United Kingdom | 108/131 |

*Primary Examiner*—Kenneth J. Dorner
*Assistant Examiner*—David A. Allred
*Attorney, Agent, or Firm*—Kirkpatrick & Lockhart

[57] ABSTRACT

A security device is provided for a foldable chair and includes a control member movably mounted between a pivot member and a vertical section of a base member, an elongated second slot defined in the control member and communicating with a first slot of the pivot member, a linking bar mounted between the two pivot members and having two distal ends each of which has a reduced diameter smaller than that of the linking bar to extend through the first slot of the pivot member and securely engage with a corresponding control member such that the control member is able move with the linking bar synchronously, the linking bar being restricted to slide along the first slot of the pivot member between a first position where the control member aligns with a first end of the pivot member such that the pivot member together with the control member are pivotally engaged with the base member, and a second position where the control member is moved to a position beyond the first end of the pivot member such that the pivot member is fixed to the base member by of the control member.

3 Claims, 5 Drawing Sheets

SECURITY DEVICE FOR A FOLDABLE CHAIR

BACKGROUND OF THE INVENTION

1. Field of Invention

The present invention relates to a security device, and more particularly to a security device for a foldable chair.

2. Related Prior Art

A conventional foldable chair is shown in FIGS. 6 and 7. However, by such an arrangement, when a user is unintentionally seated on the seat near the first leg portion (indicated by a direction of the arrow), the seat together with the base member is apt to rotate relative to the first leg portion such that the user may lose his bodily balance and fall down, so causing danger and possibly injuring the user. There will be a more complete and sufficient illustration in the detailed description of the preferred embodiments, concerning the conventional foldable chair.

The present invention has arisen to mitigate and/or obviate the above-mentioned disadvantages of the conventional foldable chair.

SUMMARY OF THE INVENTION

The primary objective of the present invention is to provide a security device for a foldable chair.

Another objective is to provide a security device which is easily assembled and dismantled.

A further objective is to provide a security device which is able to provide great safety and security for the foldable chair.

In accordance with one aspect of the present invention, there is provided a security device for a foldable chair which comprises a seat, a pair of substantially L-shaped base members each having a horizontal section fixed to an underside of the seat and a vertical section with a first end and a second end thereof, a first leg portion pivotally engaged with the first end of the vertical section of each of the base members, a pivot member having a first end pivoted to a mediate portion of the vertical section of each of the base members and a second end with upward movement limited by means of the horizontal section of the base member, an elongated first slot defined in a mediate portion of the pivot member, a second leg portion pivotally engaged with the second end of the pivot member, the first and second leg portions being pivotally engaged with each other to allow relative pivotal displacement therebetween, the security device comprising a control member movably mounted between the pivot member and the vertical section of the base member, an elongated second slot defined in the control member and communicating with the first slot, a linking bar mounted between the two pivot members and having two distal ends each of which has a reduced diameter smaller than that of the linking bar to extend through the first slot of the pivot member and securely engage with a corresponding control member such that the control member is able to move with the linking bar synchronously, the linking bar being restricted to slide along the first slot of the pivot member between a first position where the control member aligns with the first end of the pivot member such that the pivot member together with the control member are pivotally engaged with the base member, and a second position where the control member is moved to a position beyond the first end of the pivot member such that the pivot member is fixed to the base member by means of the control member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 7:
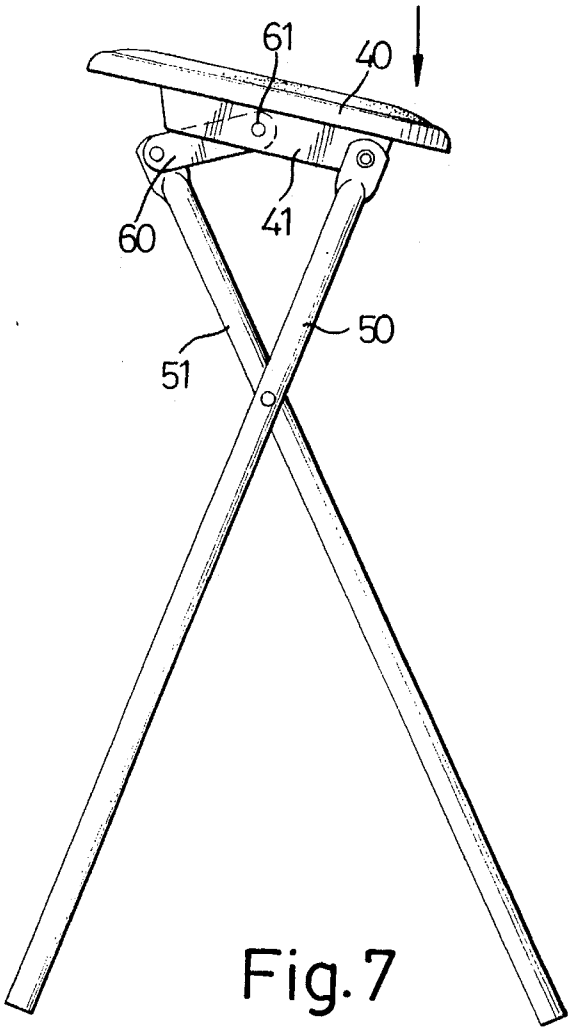
Fig.7 PRIOR ART
FIGS. 6 and 7 are side views of a conventional foldable chair in accordance with the prior art.
Figure 6:
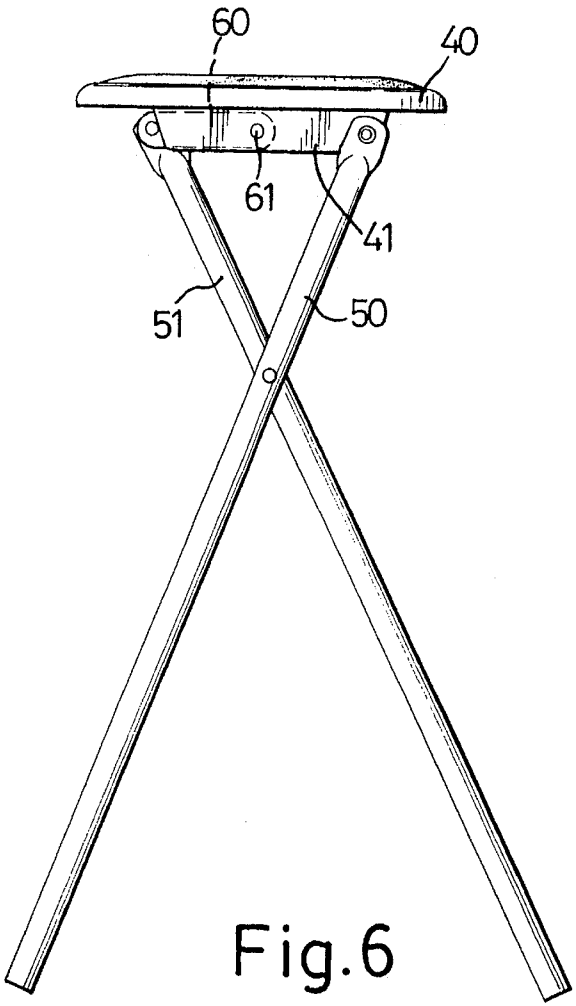
Fig.6 PRIOR ART

For a better understanding of features and benefits of the present invention, reference is made to FIGS. 6 and 7, illustrating a conventional foldable chair in accordance with the prior art. A conventional foldable chair comprises a seat 40, a pair of substantially L-shaped base members 41 each having a horizontal section fixed to an underside of the seat 40 and a vertical section with a first end and a second end thereof, a first leg portion 50 pivotally engaged with the first end of the vertical section of each of the base members 41, a pivot member 60 having a first end pivoted by means of a pivot axle 61 to a mediate portion of the vertical section of each of the base members 41 and a second end with upward movement limited by means of the horizontal section of the base member 41, a second leg portion 51 pivotally engaged with the second end of the pivot member 60, the first and second leg portions 50 and 51 being pivotally engaged with each other to allow relative pivotal displacement therebetween. By such an arrangement, when a user is unintentionally seated on the seat 40 near the first leg portion 50 (indicated by a direction of the arrow in FIG. 7), the seat 40 together with the base member 41 is apt to rotate relative to the first leg portion 50 such that the user may lose his bodily balance to fall down, so causing danger and possibly injuring the user.

Figure 1:
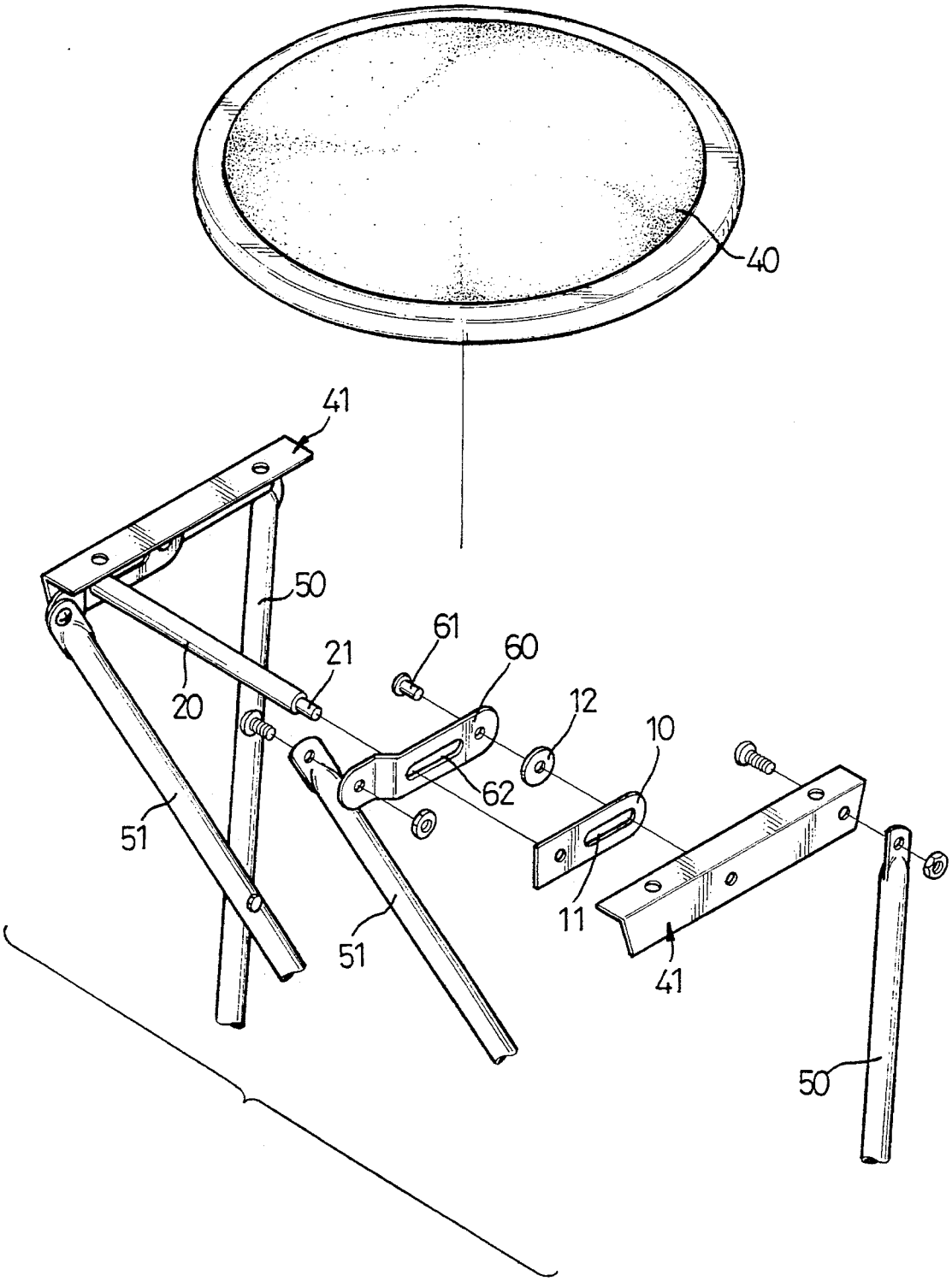
FIG. 1 is an exploded view of a security device for a foldable chair in accordance with the present invention.
Figure 2:
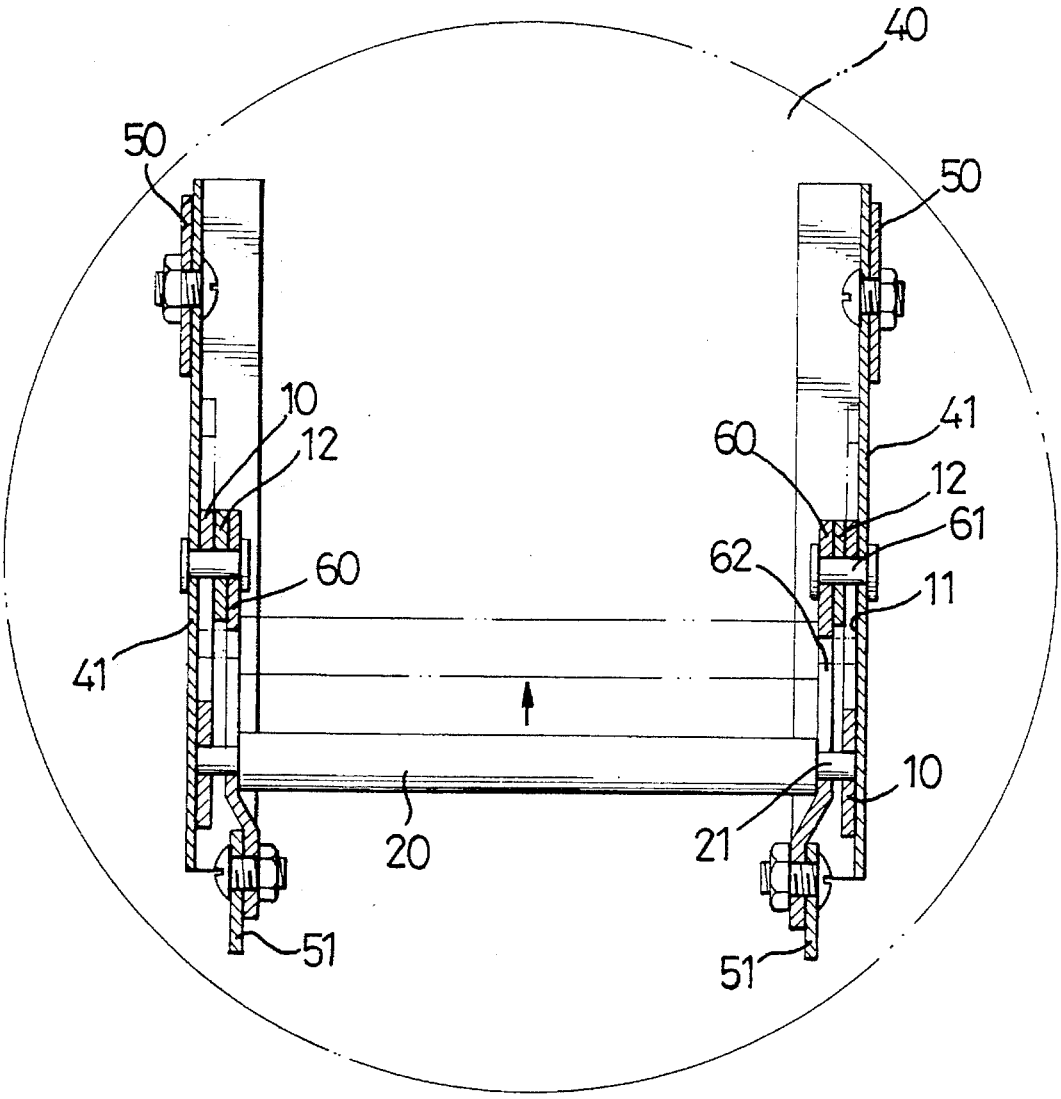
FIG. 2 is a top plan cross-sectional view of the security device as shown in FIG. 1.

Referring to FIGS. 1 and 2, a security device in accordance with the present invention is provided for a foldable chair which comprises a seat 40, a pair of substantially L-shaped base members 41 each having a horizontal section fixed to an underside of the seat 40 and a vertical section with a first end and a second end thereof, a first leg portion 50 pivotally engaged with the first end of the vertical section of each of the base members 41, a pivot member 60 having a first end pivoted by means of a pivot axle 61 to a mediate portion of the vertical section of each of the base members 41 and a second end with upward movement limited by means of the horizontal section of the base member 41, an elongated first slot 62 defined in a mediate portion of the pivot member 60, a second leg portion 51 pivotally engaged with the second end of the pivot member 60, the first and second leg portions 50 and 51 being pivotally engaged with each other to allow relative pivotal displacement therebetween.

The security device comprises a control member 10 movably mounted between the pivot member 60 and the vertical section of the base member 41, an elongated second slot 11 defined in the control member 10 and communicating with the first slot 62, a linking bar 20 mounted between the two pivot members 60 and having two distal ends 21 each of which has a reduced diameter smaller than that of the linking bar 20 to extend through the first slot 62 of the pivot member 60 and securely engage with the associated control member 10 such that the control member 10 is able to move with the linking bar 20 synchronously, the linking bar 20 being restricted to slide along the first slot 62 of the pivot member 60 between a first position where the control member 10 aligns with the first end of the pivot member 60 such that the pivot member 60 together with the control member 10 is pivotally engaged with the base member 41 and is able to rotate relative to the base member 41, and a second position where the control member 10 is moved to a position beyond the first end of the pivot member 60, such that the pivot member 60 is fixed to the base member 41 by means of the control member 10.

Preferably, the security device further comprises a washer 12 mounted between the pivot member 60 and the control member 10, the pivot axle 61 is inserted through the first end of the pivot member 60, the washer 12, extends through the second slot 11 and is riveted to the vertical section of the base member 41, whereby, when the linking bar 20 is at the first position thereof, the pivot member 60 together with the control member 10 is able to rotate synchronously relative to the base member 41 about the pivot axle 61, and when the linking bar is at the second position thereof, the control member 10 is moved to the position beyond the pivot axle 61, thereby preventing the pivot member 60 from rotating relative to the base member 41 about the pivot axle 61 so as to fix the pivot member 60 to the base member 41.

Figure 3:
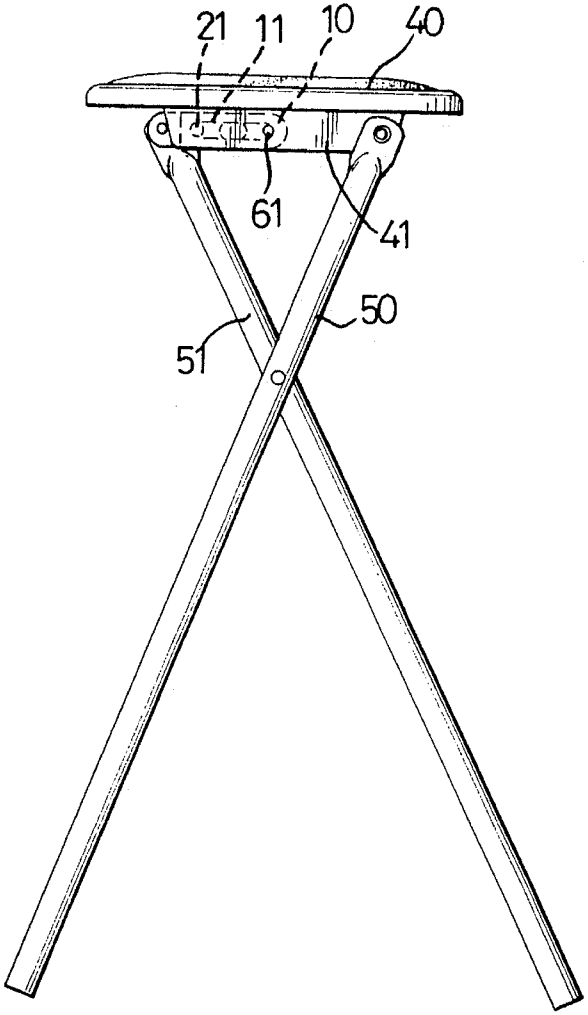
FIG. 3 is a side view of the security device showing a linking bar is at a first position thereof.
Figure 5:
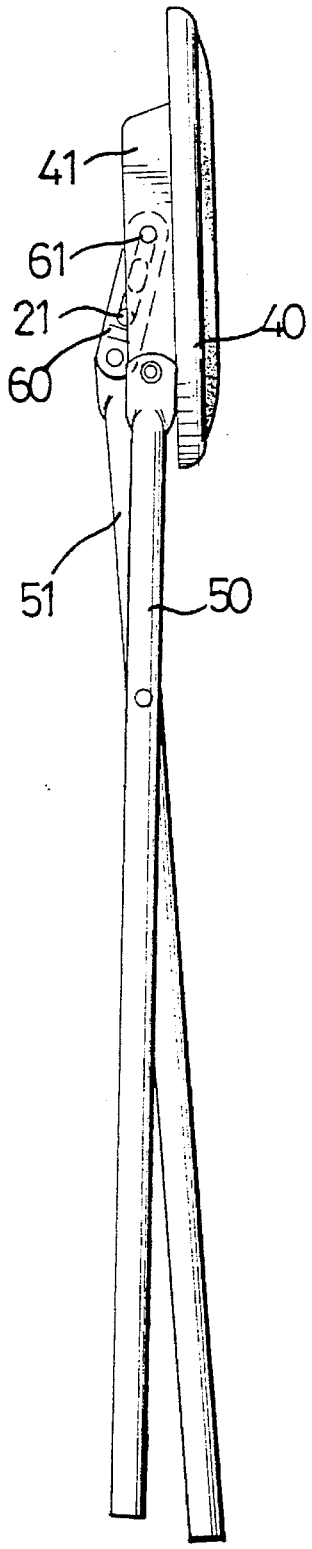
FIG. 5 is an operation view showing the foldable chair in a folding status.

In operation, referring to FIGS. 3 and 5, the distal end 21 of the linking bar 20 is at the first position in the first slot 62 of the pivot member 60 near the second leg portion 51, therefore, the control device 10 aligns with the first end of the pivot member 60 such that the pivot member 60 is able to rotate relative to the vertical section of the base member 41 about the pivot axle 61, thereby folding the chair by relative pivotal movement between the first and second leg portions 50 and 51 as shown in FIG. 5.

Figure 4:
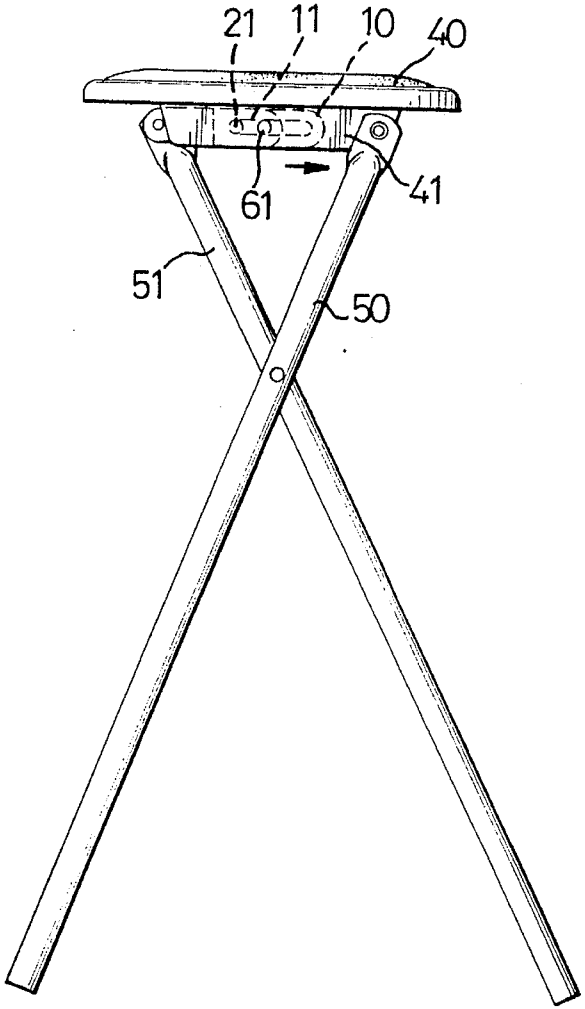
FIG. 4 is a side view of the security device showing a linking bar is at a second position thereof.

Referring to FIG. 4, the distal end 21 of the linking bar 20 is moved along the first slot 62 to the second position near the pivot axle 61 (indicated by the direction of the arrow), thereby moving the control member 10 to a position beyond the first end of the pivot member 60 so as to prevent the pivot member 60 from rotating relative to the vertical section of the base member 41 about the pivot axle 61 such that the seat 40 together with the base member 41 is not able to rotate relative to the first leg portion 50 and such that the first and second leg portions 50 and 51 are not able to pivotally move relative to each other, thereby providing a safe security effect.

Accordingly, by such an arrangement, a security device in accordance with the present invention has the following advantages and benefits:

(1) The security device is easy to be assembled and dismantled.

(2) The security device can provide great safety and security for the foldable chair even though a user is unintentionally seated on the seat near the first leg portion 50.

It should be clear to those skilled in the art that further embodiments of the present invention may be made without departing from the teachings of the present invention.

I claim:

1. A security device and a foldable chair which comprises a seat, a pair of substantially L-shaped base members each having a horizontal section fixed to an underside of said seat and a vertical section with a first end and a second end thereof, a first leg portion pivotally engaged with the first end of said vertical section of each of said base members, two pivot members each having a first end pivoted to a mediate portion of each said vertical section of each of said base members and a second end with upward movement limited by means of said horizontal section of each said base member, an elongated first slot defined in a mediate portion of each said pivot member, a second leg portion pivotally engaged with the second end of each said pivot member, said first and second leg portions and being pivotally engaged with each other to allow relative pivotal displacement therebetween, each said security device comprising a control member movably mounted between each said pivot member and each said vertical section of said base member, an elongated second slot defined in each said control member and communicating with said first slots, a linking bar mounted between said two pivot members and having two distal ends each of which has a reduced diameter smaller than that of each said linking bar to extend through said first slot of each said pivot member and securely engage with associated said control member such that said control member is able move with said linking bar synchronously, each said linking bar being restricted to slide along each said first slot of each said pivot member between a first position where said control member aligns with the first end of each said pivot member such that each said pivot member together with said control member is pivotally engaged with said base member and is able to rotate relative to said base member, and a second position where said control member is moved to a position extending beyond the first end of each said pivot member, thereby preventing each said pivot member from rotating relative to said base member such that each said pivot member is fixed to said base member by means of said control member.

2. The security device in accordance with claim 1, further comprising a washer mounted between each said pivot member and each said control member.

3. The security device in accordance with claim 2, further comprising a pivot axle inserted through the first end of each of said pivot members, said washer extended through each of said second slots and connected to said vertical section of said base member, whereby, when said linking bar is at the first position thereof, said pivot members together with said control members are able to rotate synchronously relative to said base members about said pivot axle, and when said linking bar is at the second position thereof, said control members are moved to a position extending beyond the pivot axle, thereby preventing said pivot members from rotating relative to said base member about said pivot axle so as to fix said pivot members to said base members.

* * * * *